US005516356A

United States Patent [19]

Schmit et al.

[11] Patent Number: 5,516,356

[45] Date of Patent: May 14, 1996

[54] PROCESS AND APPARATUS FOR FEEDING A SECOND STREAM OF PULVERULENT MATERIALS INTO A PNEUMATIC CONVEYING LINE CARRYING A FIRST CONTROLLABLE FLOW OF PULVERULENT MATERIALS

[75] Inventors: Louis Schmit, Luxembourg, Luxembourg; Heli DeLanghe, Evergem, Belgium

[73] Assignees: Paul Wurth S.A., Luxembourg, Luxembourg; Sidmar N.V., Belgium

[21] Appl. No.: 328,677

[22] Filed: Oct. 25, 1994

[30] Foreign Application Priority Data

Nov. 3, 1993 [LU] Luxembourg ..... 88422

[51] Int. Cl.[6] ..... C21B 7/24

[52] U.S. Cl. ..... 75/387; 75/460; 75/961; 266/83

[58] Field of Search ..... 266/182, 83; 75/459, 75/460, 463, 464, 387, 961

[56] References Cited

U.S. PATENT DOCUMENTS

| | | | |
|---|---|---|---|
| 3,337,195 | 8/1967 | Farison . | |
| 5,447,550 | 9/1995 | Leal-Cantu et al. | 75/387 |

FOREIGN PATENT DOCUMENTS

| | | | |
|---|---|---|---|
| 687234 | 8/1930 | France . | |
| 2319410 | 2/1977 | France . | |
| 421710 | 1/1992 | Japan | 75/460 |
| 5239511 | 9/1993 | Japan | 75/459 |

*Primary Examiner*—Melvyn Andrews
*Attorney, Agent, or Firm*—Fishman, Dionne & Cantor

[57] ABSTRACT

A process for feeding a second stream of pulverulent materials into a pneumatic conveying line carrying a first controllable flow of pulverulent materials is presented. The second stream of pulverulent materials is fed at a controlled rate and the control of the first flow is rendered insensitive to disturbances caused by the feeding of the second stream by directly or indirectly controlling the first flow upstream of the injection point of the second stream.

12 Claims, 2 Drawing Sheets

PROCESS AND APPARATUS FOR FEEDING A SECOND STREAM OF PULVERULENT MATERIALS INTO A PNEUMATIC CONVEYING LINE CARRYING A FIRST CONTROLLABLE FLOW OF PULVERULENT MATERIALS

BACKGROUND OF THE INVENTION

This invention to feeding pulverulent materials into a conveying line. More particularly, this invention relates to a process for feeding a second stream of pulverulent materials into a conveying line carrying a first controllable flow of pulverulent materials. One application, among many, of the present invention is the feeding of dust removed from blast-furnace gas into a flow of pulverized coal.

In systems for cleaning blast-furnace gas, the solid pollutants are separated from the gaseous phase by means of dry separators such as, for example, dust catchers, cyclones, bag filters and electrostatic precipitators. These solid residues are collected in hoppers installed directly beneath the dry separators.

These hoppers, which must be emptied regularly, freely discharge the solid residues by means of discharge devices either directly into railway wagons or lorries, or simply onto a pile beneath the hoppers. The solid residues are then loaded by mechanical shovels into railway wagons or trucks and are transported to a landfill site. It should be noted that the solid residues removed from blast-furnace gas mainly consist of iron dust and coke.

The discharging of the solid residues from the separator hoppers is a very dusty operation which without doubt, causes problems from the point of view of health and safety at the workplace and raises considerable environmental protection issues. Additionally, the dumping of the solid residues in the open air releases, in an uncontrolled manner, harmful or toxic gases and vapors, which are conveyed out of the gas cleaning system by the solid residues when the hopper is emptied. These uncontrollably released gases and vapors without doubt, represent a considerable safety problem. It is clear that this discontinuous handling of the solid residues is an unhealthy, polluting and expensive practice. To avoid having to dispose of these solid residues in landfills, consideration has been given to feeding them back into the blast furnace. It would appear that an ideal means of feeding these solid residues is clearly the system for injecting pulverized coal into the blast furnace through the tuyeres of the blast main. It would appear in fact, that the system for injecting large quantities of pulverulent materials into the blast furnace would be the ideal vehicle to convey the above discussed solid residues. If this system could be used for re-injecting the dust into the blast furnace, an ideal means of recycling the materials contained in the dust would be available and the cost of landfilling this dust would be eliminated.

The simplest method would clearly be to mix the dust with the coal in the storage bins and to inject a mixture of dust and coal into the blast furnace. However, this solution has several disadvantages. The coal storage bins are normally located at some distance from the blast furnace and the gas cleaning equipment. It would therefore be necessary to convey the dust from the cleaning plant to the storage bins and then transport it back to the blast furnace. As the dust is much more abrasive than the particles of coal, this method would cause rapid wear of the coal conveying lines. Moreover, the quantity of coal injected could not be precisely monitored, as the coal concentration is neither known nor constant.

Another potential solution would be to inject the dust into the main pneumatic conveying line carrying the pulverized coal at a point close to the blast furnace. This solution would avoid the useless conveying of dust, and wear on the pipes, due to dust abrasion, would be minimized.

However, the injection of coal is an important parameter in the operation of a blast furnace. It is therefore essential to be able to monitor precisely the flow of coal injected at any moment and it is necessary to avoid disturbing the coal injection rate by introducing a second product stream into the pulverized coal flow.

It is therefore desirable to provide a process which would enable a second stream of pulverulent materials to be fed in a controlled manner into a line carrying a first controlled flow of pulverulent materials, without disturbing this first flow.

SUMMARY OF THE INVENTION

The above-discussed and other problems and deficiencies of the prior art are overcome or alleviated by the inventive process of feeding a second stream of pulverulent materials into a pneumatic conveying line carrying a first controllable flow of pulverulent materials.

A process for the feeding of pulverulent materials into a pneumatic conveying line carrying a first controllable flow of pulverulent materials is provided wherein a second stream of pulverulent materials is fed at a controlled flow rate and the control of the first pneumatic conveying flow is rendered insensitive to the disturbances caused by the feeding of the second stream, by directly or indirectly controlling the first flow upstream of the point of injection of the second stream.

The process in accordance with the present invention has the advantage that a second stream of pulverulent materials can be injected into a pneumatic system without disturbing the control of the first flow. The first flow depends on, inter alia, conditions such as, for example, the pressure in the line at the discharge point. If the flow is directly or indirectly controlled, not at the discharge point, but at a point upstream of the injection point of the second stream, the first flow is controlled as if there were an imaginary discharge point at the control point located upstream of the second injection point. It is sufficient to take into account, in the parameters used to control the flow at this point, the influence of the section of line between the control point and the actual discharge point.

In accordance with the preferred embodiment in accordance with the present invention, the first flow is controlled by measuring the first flow of pulverulent materials and adjusting it to a predetermined value upstream of the injection point of the second stream.

In accordance with another feature of the preferred embodiment, the first flow is controlled by measuring the pressure and adjusting that pressure inside the line to a predetermined value upstream of the injection point of the second stream.

The second stream of pulverulent materials is preferably injected at the injection point into the heart, i.e., the center, of the first stream of pulverulent materials. This enables the walls of the lines to be protected against abrasion caused by the injected particles.

Preferably, the second stream of pulverulent materials is injected vertically in the direction of flow of the first stream. This enables the particles injected to be kept in the center of the first stream of pulverulent materials and to minimize abrasion.

In accordance with another feature of the preferred embodiment, the second stream of pulverulent materials is maintained at a constant flow rate. The advantage of controlling the second flow is that the disturbances caused to the system by this injection are smaller and therefore it becomes less difficult to control the first flow.

It is important to note that this process enables the two different materials to be fed at a predetermined ratio. It is therefore possible to know, at any moment, the quantity of coal that is being injected.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
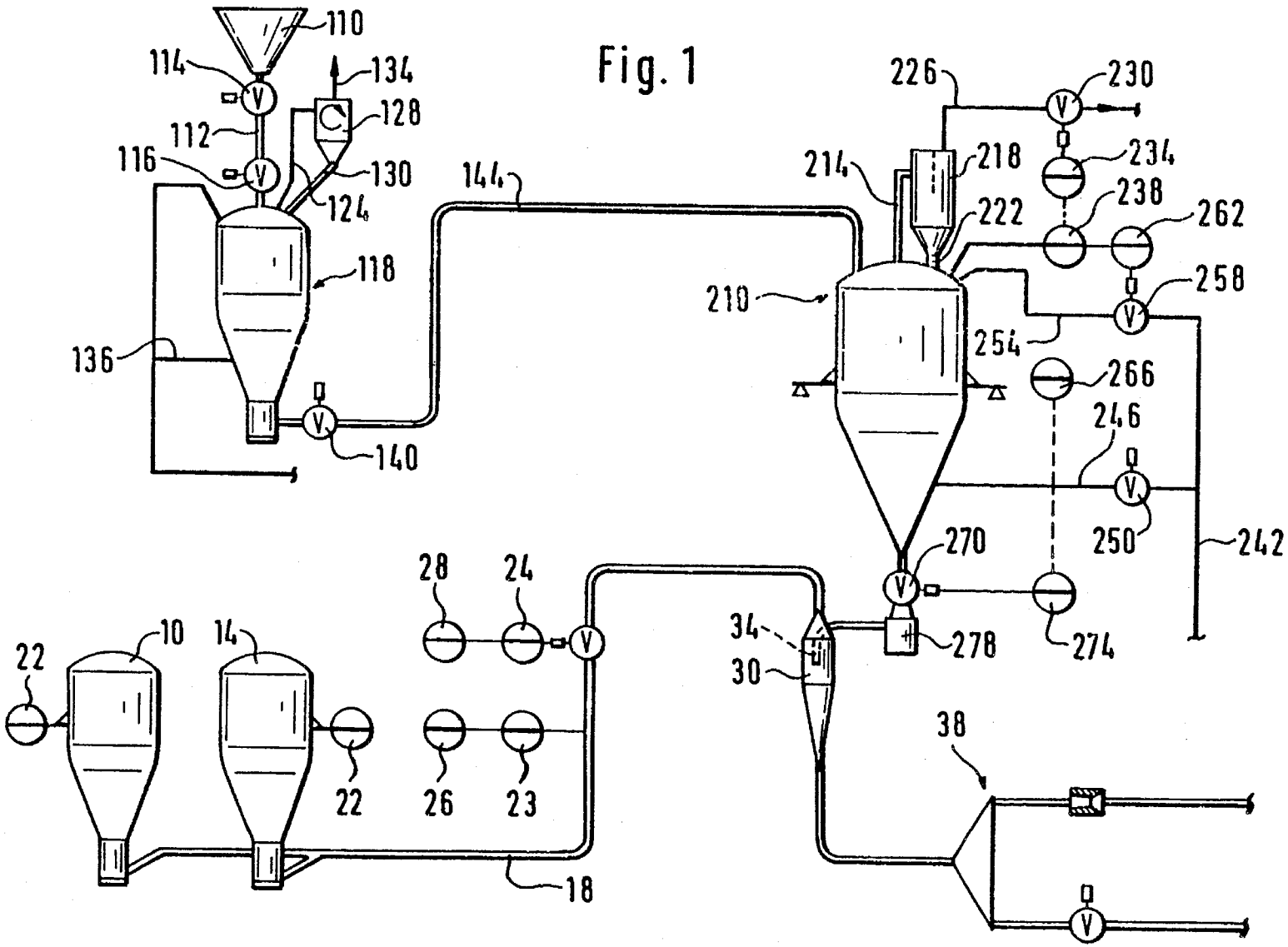
FIG. 1 is a general schematic diagram of a system for injection of pulverized coal and dust in accordance with the present invention.

Referring first to FIG. 1, the process for feeding a second stream of pulverulent materials into a pneumatic conveying line carrying a first controllable flow of pulverulent materials is diagrammatically shown. FIG. 1 shows two injection bins 10 and 14 for the pulverized coal. These two bins alternately supply a discharge line 18 and are each equipped with a weighing system 22 enabling the weight of the bin to be checked at any time and thus the quantity of pulverized coal discharged per unit time. The discharge line 18 is equipped with a direct flow measuring device 23 and a direct flow adjusting device 24 or, respectively, a pressure measuring device 26 and a pressure adjusting device 28 located upstream of an injection device 30 for a second stream of pulverulent materials. The monitoring device 23 and the flow adjusting device 24 or, alternatively, the pressure monitoring device 26 and the pressure adjusting device 28 enable the flow of coal to be controlled efficiently and simply in relation to the pressure prevailing in the pulverized coal injection bins. At the control point, the pressure inside the line 18 is maintained at a higher level than the injection pressure of the second material at the level of the injection device 30. In this way, the injection of the second material will not disturb the pulverized coal flow. The flow of coal thus becomes independent of the pressure at the discharge point.

The injection device 30 is preferably located in a vertical section of the line 18 in order to facilitate the feeding of the second product.

The device 30 consists of a widened section of the line 18, into which the second material is injected by means of an injection tube 34 preferably located in the center of the widened section of the line 18. In this way, the second material, which is more abrasive than the coal, is kept in the center of the coal flow, which protects the lines from abrasion by the injected particles.

The line 18 ends in a distribution device 38 for pulverulent materials such as is described in, for example, U.S. Pat. No. 5,123,632, the entire contents of which are incorporated herein by reference. In this device the flow of materials is divided and directed to the various blast mains and is finally injected into the blast furnace.

The feeding system for the pulverulent materials injected into the pneumatic conveying line by means of the tube 34 comprises a hopper 110 installed beneath a solid particle separator (not shown) of a blast-furnace gas cleaning system. This hopper 110 receives the solid residues removed by the separator from the blast-furnace gas. It should be noted that this blast-furnace gas contains toxic gases such as CO and larger or smaller quantities of water vapor. The solid residues mainly consist of coke, coal and iron ore dust.

A discharge line 112, equipped upstream with a sealing device 114 for the solid residues and downstream with a gas-tight isolating valve 116, connects the hopper with a closed vessel 118. The closed vessel 118 forms a heat-insulated pressure vessel, into which the discharge line 112 opens at the top. The vessel 118 is equipped in its lower part with a fluidizing device 120 enabling a gas to be blown in from below through the solid residues discharged into the closed vessel 118. The fluidizing device comprises, for example, a gas-permeable peripheral surface delimiting, in the lower part of the vessel 118, the storage space for the solid residues.

Leading off from the upper part of the closed vessel is a venting and pressure relief pipe 124. This venting and pressure relief pipe 124 is preferably connected to a separator 128. A hopper beneath the filter of the separator 128 discharges into the vessel 118 through a discharge pipe 130 fitted with a gas-tight isolating valve (not illustrated). The venting and pressure relief gases filtered by the separator 128 are discharged through a discharge pipe 134 fitted with a gas-tight isolating valve (not illustrated).

Gas is supplied to the fluidizing device 120 by means of a pipe 136 connected to a gas supply (not shown).

The bottom end of the vessel 118 opens into a pneumatic conveying line 144 via an isolating valve 140.

The operation of the device described in the foregoing may be summarized as follows:

The discharge pipe 112 enables, by opening the isolating valve 116 and then the sealing device 114, the solid residues to be discharged by gravity from the hopper 110 into the closed vessel 118. When the closed vessel is filled to a certain level, which is detected by a level detector, the sealing device 114 is closed first, interrupting the discharge stream before the gas-tight isolating valve 116 is closed. During the filling of the vessel 118, the venting valves and the isolating valve are kept open in order to allow the gaseous contents of the vessel 118 to be discharged.

Then the fluidizing device 120 is fed with a constant flow of inert gas. This gas flow is blown in from below through the solid residues in order to create a stationary bed or a fluidized bed of solid particles.

The inert gas carrying the gases and vapors contained in the vessel 118 and trapped in the solid residues is discharged via the pipe 124 and the filter 128 in the venting pipe 134. In the separator 128 the mixture of gases is separated from the entrained solid particles.

The closed vessel 118 is joined to a surge bin 210 via the line 144. This bin, too, is equipped in its upper part with a pressure relief pipe 214. This pressure relief pipe 214 is advantageously connected to a separator 218. A hopper in the lower part of the separator 218 discharges the solid particles captured by the filter into the bin 210 through a discharge pipe 222 fitted with a gas-tight shut-off valve (not illustrated). The pressure relief gases filtered by the separator 218 are discharged through a discharge pipe 226 fitted with a gas-tight isolating valve. This valve 230 is connected to a device 234 for regulating the pressure controlled by a pressure measuring device 238 which continuously monitors the pressure prevailing inside the bin 210. A gas supply source (not illustrated) supplies the bin 210 with gas by means of a pipe 242. The first branch 246, which contains a gas-tight valve 250, supplies a fluidizing device of the kind described above which is located in the lower part of the bin 210. The second branch 254 supplies the upper part of the bin 210 with gas. This supply is regulated by a valve 258 fitted with a regulating device 262, controlled by the pressure measuring device 238.

This equipment enables the pressure inside the bin 210 to be monitored and controlled at all times. During the filling of the bin 210, the excess pressure is relieved via the pressure relief pipe 214. The regulating device 234, which is controlled by the pressure measuring device 238, allows only the quantity of gas to escape which is required to maintain the pressure inside the bin 210 at a predetermined value. During the emptying of the bin, gas is injected into the fluidizing device and, if necessary, through the pipe 254, the valve of which is open if the pressure falls below a setpoint value. By virtue of this pressure regulation, this bin 210 may be filled and emptied simultaneously without varying the discharge flow rate.

The bin 210 is also equipped with a weighing system 266 so as to be able to determine the weight of the bin 210 at all times and to derive from it the flow rate during emptying.

The pulverulent materials fluidized inside the bin 210 are discharged through the bottom part of the bin 210, which is equipped with a sealing device 270 controlled by a flow computation device 274 linked to the weighing system 266.

The material stream is fluidized in a fluidizing chamber 278 located at the outlet of the bin 210 before the stream is injected into the discharge line 18 via the injection device 30. This method of operation enables a controlled flow of pulverulent materials to be continuously injected into the line 18.

It should be noted that one of the great advantages of this system is that the dust is re-injected into the blast furnace without coming into contact with the atmosphere. Pollution of the environment and the workplace by the dust is consequently totally eliminated.

It should be noted that all of the expense of handling this dust and the subsequent cost of land fill space to both the environment and the pocketbook is thus saved.

Figure 2:
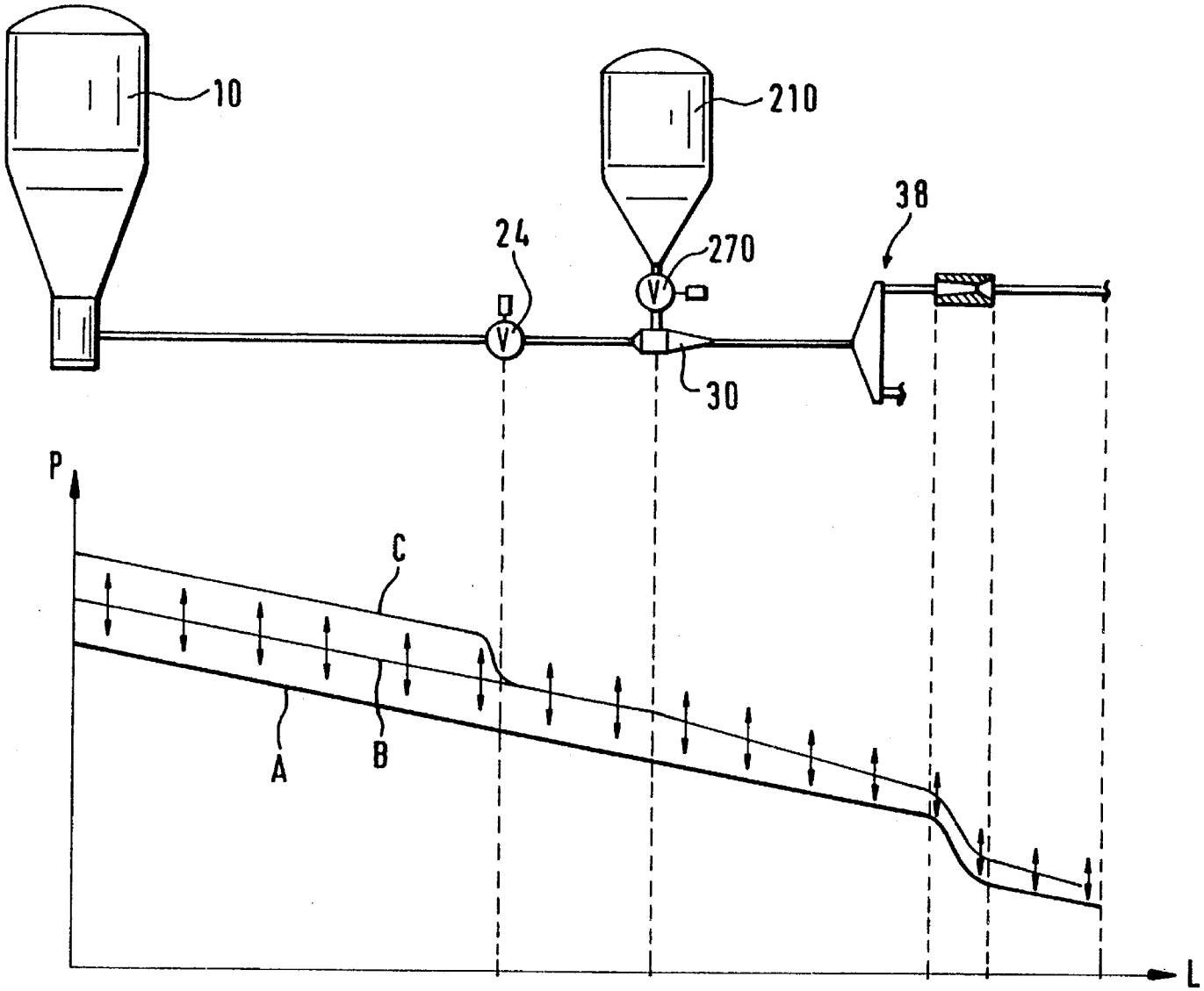
FIG. 2 is a diagram of the pressures prevailing at various points of a system for (A) the prior an without a second stream being injected, (B) a system incorporating a second stream being injected but lacking regulating control and (C) a system in accordance with the present invention with full regulating control.

Referring now to FIG. 2, which shows the comparison of a pneumatic circuit in which (A) shows a pressure diagram for a pipe which does not contain a second stream of pulverulent materials; (B) shows a pressure diagram for a device for injecting a second stream of pulverulent materials without pressure regulating means; and (C) the same as (B) but with pressure regulating means.

Curve A shows a pressure diagram for a pipe which does not contain a device for injecting a second stream of pulverulent materials. It can be seen clearly that the prior art as represented by curve A must be run at a lower pressure and thus at a lower flow rate of the pulverized coal over time.

Curve B shows a pressure diagram for a circuit containing a device for injecting a second stream of pulverulent materials without a regulating device. The vertical arrows indicate the pressure variations over time in this circuit. Without regulation, the pressures and consequently the flow rates vary considerably and the first flow of materials, i.e. of the pulverized coal in this case, varies very widely in relation to the pressure variations induced by the second stream. Under these conditions it becomes very difficult to monitor the operation of the blast furnace, as it is no longer possible to efficiently and reliably control the quantity of coal injected over time.

Lastly, curve C illustrates the pressure variations in the circuit when regulated in accordance with the present invention. The regulating device 24 plays an important role in adjusting the pressure and consequently the flow rate of injected coal. In fact, the regulating device 24 permits operation at a higher feed pressure for the same flow of pulverized coal, and this pressure is independent of the pressure variations prevailing in the remainder of the circuit. By further opening or closing the regulating device, a larger or a smaller pressure drop is created, so as to adjust the pressure upstream of this device to the variations in pressure created by the device for injecting the second stream of pulverulent materials. If the pressure were to rise downstream of the regulating device, the regulating device would be opened further so as to create a smaller pressure drop. If, on the other hand, the pressure were to fall downstream of the regulating device, the regulating device would be closed further so as to create a larger pressure drop. It is important to stress that this artificial, controllable pressure drop does not influence the flow of injected coal, as the pressure in the storage bin is not influenced by the regulating device. It should be noted that the flow of pulverized coal over time is maintained at higher rates and also non-fluctuating rates all along the system in accordance with the present invention.

While preferred embodiments have been shown and described, various modifications and substitutions may be made thereto without departing from the spirit and scope of the invention Accordingly, it is to be understood that the present invention has been described by way of illustration and not limitation.

What is claimed is:

1. A process for supplying pulverulent materials in a pneumatic conveying system, including the steps of:

generating a first stream pulverulent material in a conveying line;

injecting a second stream of pulverulent material into said conveying line and into said first stream of pulverulent material; and controlling the rate of flow of said first stream of pulverulent material in said conveying line at a point in said conveying line upstream of the point of injection of said second stream of pulverulent material to render said first stream of pulverulent material insensitive to any disturbances caused by the injection of said second stream of pulverulent material into said first stream of pulverulent material.

2. The process of claim 1 wherein said first stream of pulverulent material is controlled by measuring the rate of flow of said first stream of pulverulent material at a point upstream of the point of injection of said stream of pulverulent material and adjusting said rate of flow to a predetermined value upstream of the injection point of said second stream of pulverulent material.

3. The process of claim 1, wherein said first stream of pulverulent material is controlled by measuring the pressure thereof in said conveying line at a point upstream of the point of injection of said second stream of pulverulent material and adjusting said pressure inside said pneumatic conveying line to a predetermined value upstream of the injection point of said second stream of pulverulent material.

4. The process of claim 1, wherein said second stream of pulverulent material is injected into said first stream of pulverulent material at an injection point located in the center of the first stream of pulverulent material.

5. The process of claim 1, wherein the second stream of pulverulent material is injected vertically into the pneumatic conveying line in the direction of flow of said first stream of pulverulent material.

6. The process of claim 1, wherein the rate of flow of said second stream of pulverulent material is maintained constant.

7. Apparatus for supplying pulverulent materials in a pneumatic conveying system, including:

means for generating a first stream of pulverulent material in a conveying line;

means for injecting a second stream of pulverulent material into said conveying line and into said first stream of pulverulent material; and means for controlling the rate of flow of said first stream of pulverulent material in said conveying line at a point in said conveying line upstream of the point of injection of said second stream of pulverulent material to render said first stream of pulverulent material insensitive to any disturbances caused by the injection of said second stream of pulverulent material into said first stream of pulverulent material.

8. The apparatus of claim 7 wherein said means for controlling said first stream of pulverulent material includes:

means for measuring the rate of flow of said first stream of pulverulent material at a point upstream of the point of injection of said second stream of pulverulent material; and means for adjusting said rate of flow to a predetermined value upstream of the injection point of said second stream of pulverulent material.

9. The apparatus of claim 7, wherein said means for controlling said first stream of pulverulent material includes:

means for measuring the pressure thereof in said conveying line at a point upstream of the point of injection of said second stream of pulverulent material; and means for adjusting said pressure inside said pneumatic conveying line to a predetermined value upstream of the injection point of said second stream of pulverulent material.

10. The apparatus of claim 7, wherein said mans for injecting said second stream of pulverulent material includes:

means for injecting said second stream of pulverulent material into said first stream of pulverulent material at an injection point located in the center of the first stream of pulverulent material.

11. The apparatus of claim 10, including:

means for injecting the second stream of pulverulent material vertically into the pneumatic conveying line in the direction of flow of said first stream of pulverulent material.

12. The apparatus of claim 7, including:

means for maintaining constant the rate of flow of said second stream of pulverulent material.

* * * * *